US006955179B2

(12) United States Patent
Ecker et al.

(10) Patent No.: US 6,955,179 B2
(45) Date of Patent: Oct. 18, 2005

(54) STRAIGHT-THROUGH DISHWASHER WITH A CARRIAGE WHICH IS DRIVEN IN OPPOSITE DIRECTIONS

(75) Inventors: Engelbert Ecker, Offenburg (DE); Joachim Kupetz, Windschlaeg (DE); Joachim Bruder, Offenburg (DE); Michael Streb, Iffezheim (DE)

(73) Assignee: MEIKO Maschinenbau GmbH & Co., Offenburg (DE)

( * ) Notice: Subject to any disclaimer, the term of this patent is extended or adjusted under 35 U.S.C. 154(b) by 351 days.

(21) Appl. No.: 10/334,189

(22) Filed: Dec. 30, 2002

(65) Prior Publication Data

US 2004/0123884 A1 Jul. 1, 2004

(51) Int. Cl.[7] ..... B08B 3/00

(52) U.S. Cl. ..... 134/134; 134/133; 134/164; 134/165; 211/41.8; 211/41.9

(58) Field of Search ..... 134/134, 133, 134/135, 123–131, 58 D, 57 D, 56 D, 164, 134/165; 211/41.8, 41.9, 89.01; 198/737

(56) References Cited

U.S. PATENT DOCUMENTS

| | | | | |
|---|---|---|---|---|
| 122,750 | A * | 1/1872 | Whitney | 198/737 |
| 3,083,716 | A * | 4/1963 | Rowan et al. | 134/46 |
| 5,507,877 | A * | 4/1996 | Magsig et al. | 134/18 |
| 6,026,831 | A * | 2/2000 | Jarvis | 134/72 |

FOREIGN PATENT DOCUMENTS

EP 917277 A1 * 5/1999

OTHER PUBLICATIONS

Gaus, Bruno; Motor Drive; English Translation of German Patent EP 0917277 A1.*

* cited by examiner

*Primary Examiner*—Michael Barr
*Assistant Examiner*—Sarah E. Husband
(74) *Attorney, Agent, or Firm*—Davidson, Davidson & Kappel, LLC

(57) ABSTRACT

A motor drive with devices for translating the rotary movement of an output shaft (44) into a reciprocating linear movement, preferably for driving a reciprocating transporting device (4; 5, 6). The latter comprises catches (9; 9.1, 9.2), which engage in one direction and not in the other direction, in order to transport a receptacle (16) for items for washing. The transporting device comprises an articulated transporting frame (4), of which the transporting rails (5, 6) can be moved in opposite directions to one another.

12 Claims, 6 Drawing Sheets

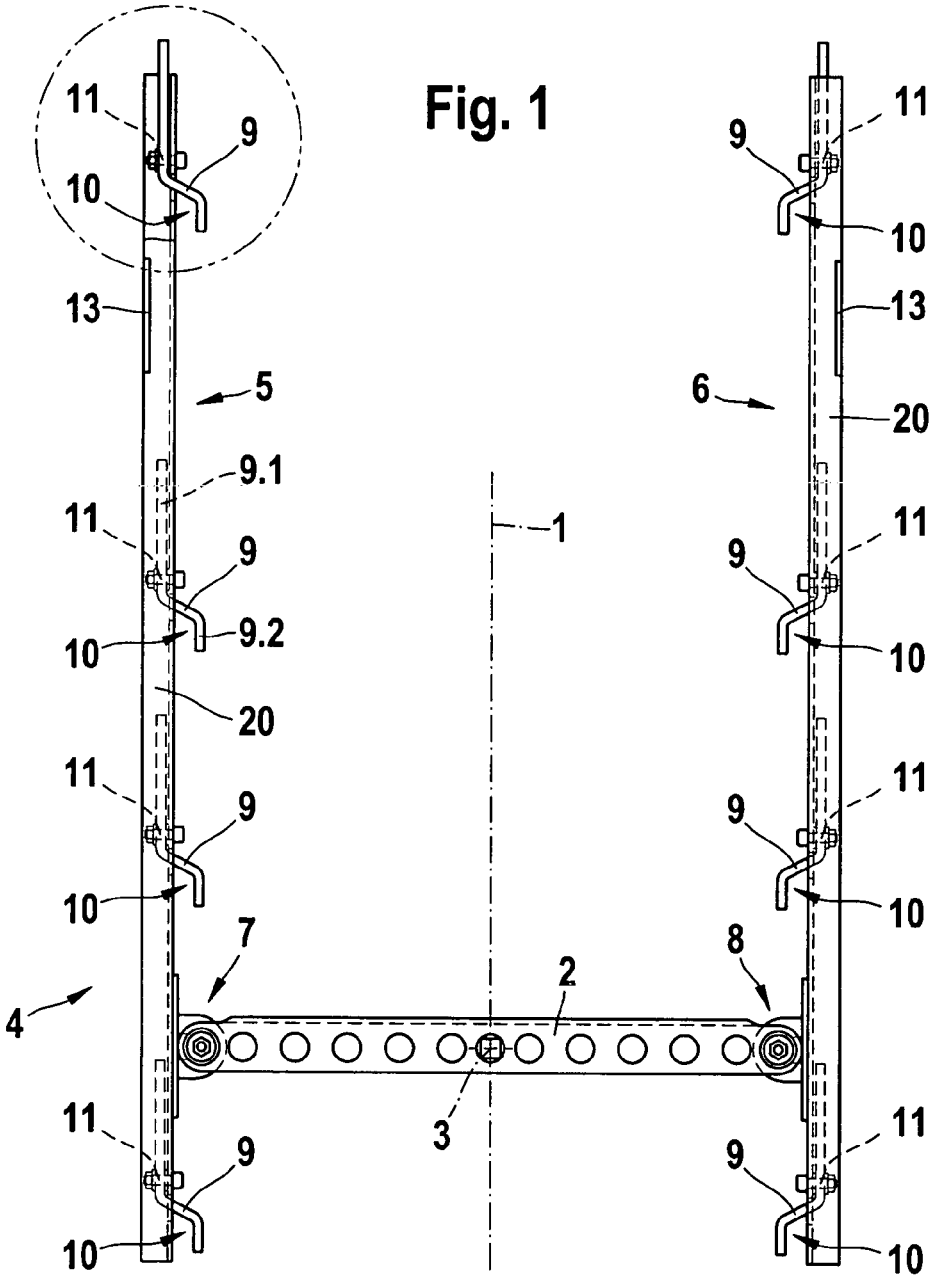
Fig. 1
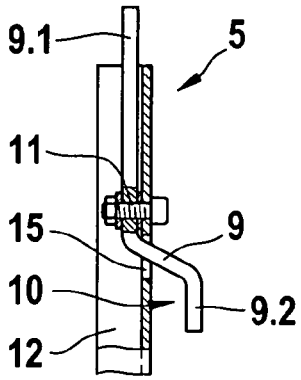
Fig. 1.1

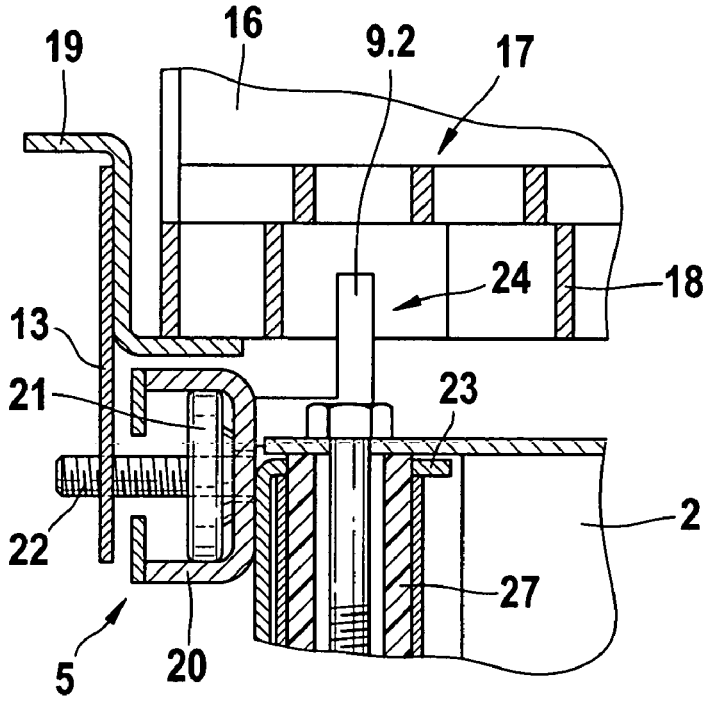
Fig. 3.1
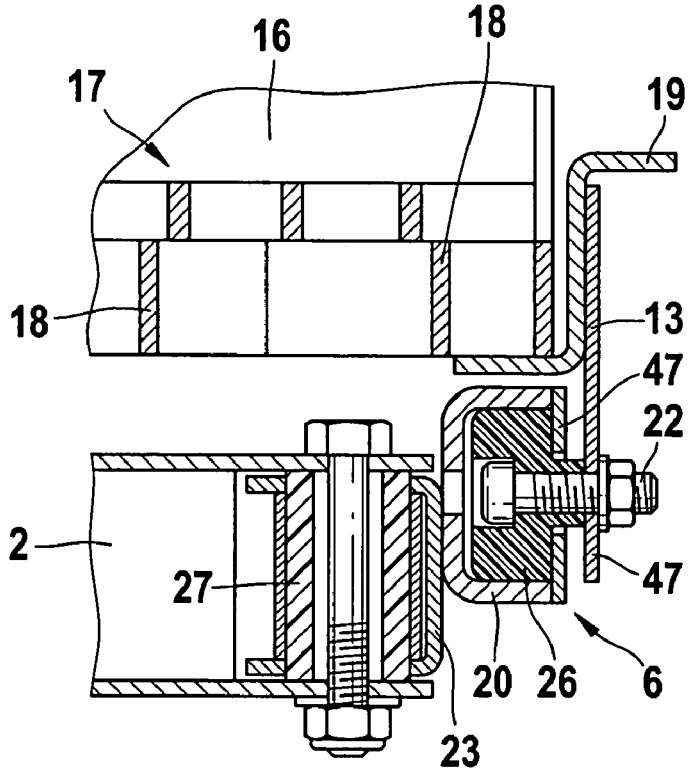
Fig. 3.2

STRAIGHT-THROUGH DISHWASHER WITH A CARRIAGE WHICH IS DRIVEN IN OPPOSITE DIRECTIONS

BACKGROUND INFORMATION

The invention relates to a straight-through dishwasher in the case of which the carrier bodies accommodating the dishes which are to be cleaned are conveyed through the straight-through dishwasher by means of a transporting mechanism which comprises a transporting carriage. A carrier rack is usually provided for straight-through dishwashers, and this makes it possible for the dishes to be easily transported even outside the machine on conveying belts or curves. The items for washing can be easily introduced into the carrier racks and also easily removed again therefrom. During slack periods, with only a small amount of dishes, the dishes which are to be cleaned are first of all collected in a plurality of carrier racks, with the result that the machine can be operated cost-effectively, i.e. only with fully loaded carrier racks.

Longitudinally extending lateral rack-guide rails which are fitted in the machine interior ensure that the carrier racks are transported through the straight-through dishwashers. The carrier rack rests on said rack-guide rails. Located beneath the rack-guide rails is a transporting element which is of carriage-like design and is provided with tilting catches which allow a pivoting movement. The tilting catches automatically rotate into a certain position on account of their configuration and mounting, with the result that the tips of the tilting catches project into a ribbing arrangement which is formed on the underside of a carrier body. The tilting catches may be configured, for example, in the manner of a barb and, during a forward movement of the carriage-like transporting element, push the carrier rack forward in accordance with the length of a stroke movement. In the case of a rearward movement of the carriage-like element being executed, the rotatably mounted tilting catches can move away downward beneath the ribbing arrangement of the carrier rack until they can move into the upright position again in a rib interspace on the underside of the carrier rack. This means that the carrier basket remains stationary during the rearward movement of the carriage-like transporting element. In the case of a renewed forward movement of the carriage-like transporting element, the tilting catches engage in the ribbing arrangement of the carrier rack again and push the carrier rack forward in accordance with the stroke movement of the carriage-like transporting element.

Common configurations of the carriage-like transporting element are provided by a single stroke-executing carriage which is arranged centrally between the rack-guide rails and of which the tilting catches engage in the center of the carrier rack. Another variant provides a rigid rectangular frame, of which the two carriage profiles provided with the tilting catches engage on the outer borders of the carrier rack. The carriage profiles extend laterally, in the longitudinal direction of the machine, in the region of the rack-guide rails.

The forward and rearward movement of the carriage-like transporting element is produced in that the rotary movement of a gear motor is converted, by means of a crank mechanism, into a purely forward and rearward movement of the guide-like transporting element. Depending on the configuration of the crank mechanism, it is possible to realize stroke movements which are between approximately 80 mm and 250 mm per motor revolution. On account of this design principle, the carrier rack with the items for washing located therein, rather than being conveyed through the machine at a uniform transporting speed, is only transported during a half motor revolution and remains stationary during the other half motor revolution, when the carriage-like transporting element executes a rearwardly directed movement. This technology does indeed realize a straightforward design principle, which allows cost-effective production and constitutes a robust possible configuration.

The disadvantage with this design principle, however, is the fact that the transporting movement of the carrier rack, rather than running uniformly, is interrupted. It is thus the case that, with the same average transporting speeds and otherwise identical washing parameters as for a continuous belt machine, a poorer washing result is achieved in comparison with the latter. Average transporting speed is to be understood as the overall distance which the carrier rack has to cover divided by the time required for this purpose.

In order to compensate for the standstill time of the carrier rack, which takes place during the rearward stroke of the carriage-like transporting element, the carrier rack is moved at far more than double the transporting speed during the forward movement. The design results in the ratio of advancement time to standstill time of the carrier rack being approximately 40 to 60. This means that the carrier rack is only moved during 40% of the time which the output shaft of the gear mechanism requires for one revolution, and which is theoretically available for the advancement, and is stationary during 60% of this time.

The washing result depends directly, inter alia, on how long a flat spray jet from individual nozzles works on the soiled surface of the items for washing. A non-uniform movement sequence with its brief phases of high transporting speed has an adverse effect on the washing result achieved. The strokewise movement of the carrier rack with its brief phases of high transporting speed has a particularly disadvantageous effect, in this context, on the result of the rinsing with clean water. In the clean-water rinsing zone, a fan-like spray jet is only produced over a single line, transversely to the direction of travel of the carrier rack, said spray jet coming into contact with the surface of the items for washing. The rinsing result, via the spray jet, on a glass which passes said linear spray jet, on account of the jerky movement having a brief high-speed phase, is not satisfactory.

EP 0 917 277 A1 relates to a motor drive. The motor drive comprises devices for translating the rotary movement of the drive shaft into a reciprocating linear movement. The motor drive preferably serves for driving a reciprocating transporting rail of a straight-through dishwasher. A bearing comprising two half-shells of semicylindrical cross section is provided on a drive shaft. At least one of the half-shells interacts with a switching device. When a certain lateral deflection of the at least one part-shell is exceeded, the switching device switches the motor drive in particular.

SUMMARY OF THE INVENTION

In view of the prior art outlined an object of the invention is to alter the ratio of advancement period to standstill time of the carrier rack such that the standstill period is reduced to a minimum and the advancement period, in favor of a lower transporting speed, is increased to a maximum.

The advantages which can be achieved by the solution proposed according to the invention may be seen, in particular, in that, with the same dishes output (quantity of dishes cleaned within a certain time), a far better washing result can be achieved by the more uniformly running movement of the carrier rack through the straight-through dishwasher. On the other hand, with otherwise identical washing parameters, it is possible to increase the dishes output (quantity of dishes cleaned within a certain unit of time) in order to obtain the same washing result.

It is also possible, as a result of the movement of the carrier rack through the washing zone running more uniformly in accordance with the solution proposed by the invention, to reduce to a considerable extent the quantity of clean water necessary, in particular, for the rinsing process, e.g. the operation of rinsing off washing liquid with clean hot water. On account of the reduced quantity of clean water, it is also possible to reduce the heating output necessary for heating up the same clean water, which increases the cost-effectiveness and the efficiency of the straight-through dishwasher to a considerable extent.

The transporting rails of the articulated transporting frame, it being possible for said transporting rails to be moved in opposite directions to one another, are connected to one another via an articulated cross member, on which a pivot pin acts. It is thus advantageously possible to achieve the situation where the respective forward-stroke movement of one transporting rail corresponds to the return-stroke movement of the other transporting rail. The transporting rails are preferably designed as hollow profiles which may be available as standard parts and, in particular, have a cavity. The top and bottom surfaces which bind the cavity serve for mounting the hollow profiles by way of slide bearings or may alternatively serve, in an advantageous manner, as rolling surfaces for rolling elements which pass laterally through the profiles.

A cross member serving as pivoting arm is preferably driven via a crank mechanism which has a two-part connecting rod. Dividing the connecting rod into two parts makes it possible for the pivoting angle of the pivot pin driving the transverse profile to be adjusted such that the pivoting angle executed by the pivot pin can be adapted to individual requirements in respect of the stroke length of the articulated transporting frame. Furthermore, the crank mechanism, which transmits the reciprocating linear movement, comprises a drive wheel which is moved by the output shaft of a gear mechanism driven via the pivot drive. The drive train for realizing the pivoting movement of the cross member comprises the following components: motor, gear mechanism, output shaft of the gear mechanism, the drive wheel, a two-part connecting rod and the pivot pin connected in a rotationally fixed manner to the cross member.

One of the connecting-rod parts of the two-part connecting rod is articulated on the drive wheel. The transporting rails execute in each case two stroke cycles, comprising conveying stroke, for the receptacle which is to be conveyed, and return stroke, during one revolution of the drive wheel driven by the gear mechanism of the pivot drive.

The catches arranged in a pivotable manner in the walls of the transporting rails, which are designed as hollow profiles, advantageously have a counterweight-forming section, which allows independent pivoting, and an extendable protrusion which grips the rack for items for washing. The transporting rails enclose slide-bearing blocks or, alternatively, roller elements which are accommodated in a rotatable manner on pins, in which case the slide-bearing blocks or, alternatively, the pins, for their part, are accommodated on mounting elements which are fitted on guide rails fitted in a stationary manner in a straight-through dishwasher. The guide rails serve for supporting the rack which accommodates the items for washing, and advantageously has a ribbed base surface in which the protrusions of the automatically movable catches engage.

BRIEF DESCRIPTION OF THE DRAWINGS

The invention is described in more detail hereinbelow with reference to the drawing, in which:

FIG. 1 shows the plan view of a transporting frame designed in the manner of a carriage, FIG. 1.1 shows an enlarged illustration of an end region of a transporting rail of the articulated transporting frame.

DETAILED DESCRIPTION

Figure 2:
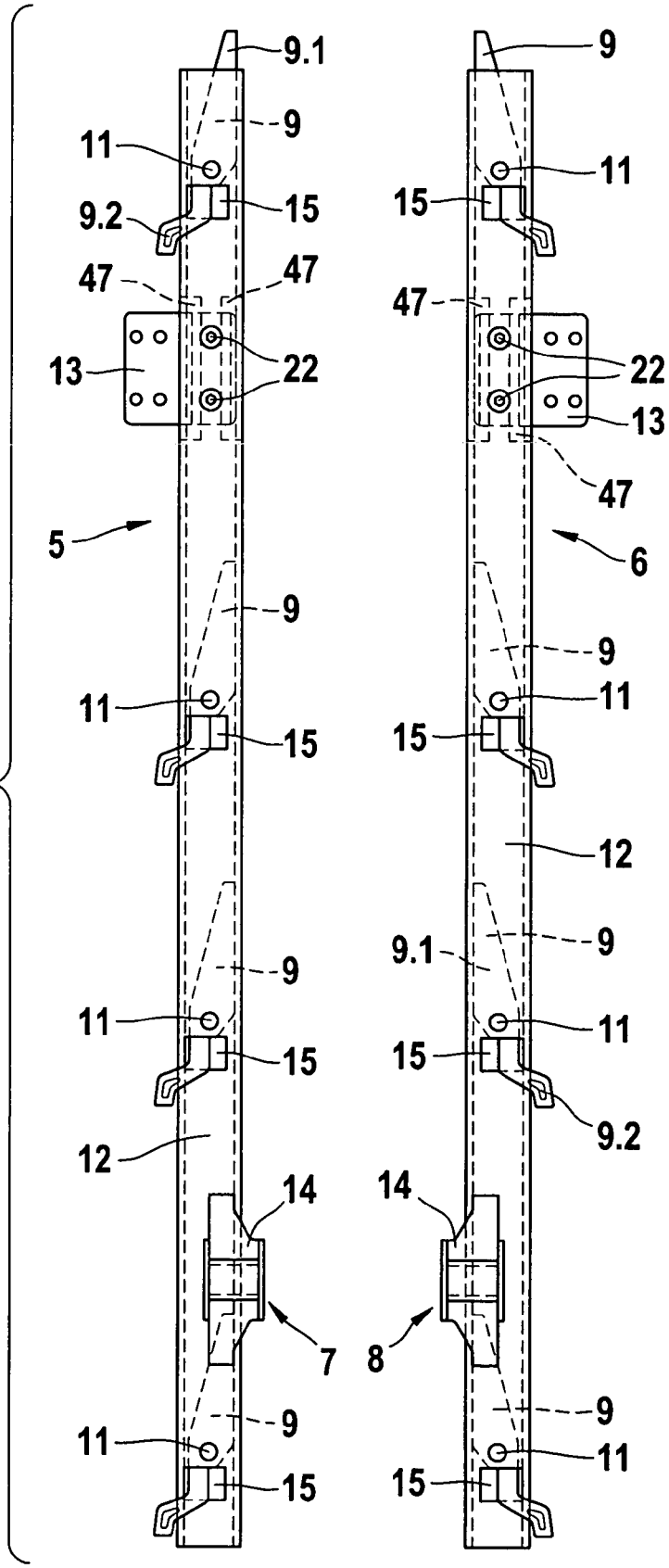
FIG. 2 shows the side views of the transporting rails of the articulated transporting frame.

The illustration according to FIG. 1 shows the plan view of a transporting element which is designed in the manner of a carriage and is intended for transporting racks through a straight-through dishwasher.

A transporting frame 4 is constructed symmetrically in relation to an axis of symmetry 1 and comprises a first transporting rail 5 and a second transporting rail 6. The two transporting rails 5, 6 are coupled to one another in an articulated manner via a pivoting arm 2. The pivoting arm 2 can be pivoted about a pivot pin 3 via a drive which is not illustrated in FIG. 1. By virtue of the pivoting movement introduced into the pivoting arm 2 via the pivot pin 3, the first transporting rail 5 and the second transporting rail 6 of the transporting frame 4 are moved in the manner of a parallelogram, e.g. in opposite directions to one another, in the plane of the drawing. The first transporting rail 5 and the second transporting rail 6 are coupled in an articulated manner via a first point of articulation 7 and a second point of articulation 8. The first and the second transporting rails 5, 6 each comprise catches 9 which, in the illustration represented in FIG. 1, are each provided with an angled portion 10. The pivot pins on which it is possible to move the catches 9 on the first transporting rail 5 and the second transporting rail 6 are designated 11. The two transporting rails 5 and 6 are provided with a profiling 12 and are each open in the direction of the outside. The first and the second transporting rails 5, 6 each form a guide 20 for the transporting frame 4. The pivot pins 11 of each catch 9 are accommodated in a wall of the transporting rails 5, 6. The individual catches 9, which are accommodated in a movable manner on the first transporting rail 5 and the second transporting rail 6, are configured such that they are capable of moving automatically about the pivot pin 11. In the case of an advancement movement of the transporting rails 5, 6, which serve for transporting a rack (not illustrated in FIG. 1) for accommodating items for washing, the catches 9 move, by way of their angled ends 10, in an upright position, in which they grip the underside of the rack, which is provided with a ribbing arrangement and accommodates the items for washing, while, in the case of corresponding return-stroke movement of the first transporting rail 5 and of the second transporting rail 6, the catches 9 pivot into a more or less horizontal position, with the result that the angled ends 10 release the underside of the previously gripped rack.

Mounting plates 13 are fastened on stationary rack-guide rails. Narrow securing plates 47 are attached to the top and the bottom legs in each case of the two transporting rails 5, 6 (see FIG. 2). These prevent the transporting rails 5, 6, which are profiled in a U-shaped manner, from sliding out of a slide bearing. The rack-guide rail, the mounting plate 13 and the slide bearing are arranged in a stationary manner, it being possible for the transporting rails 5, 6 to be moved relative thereto.

FIG. 1.1 shows an enlarged illustration of an end region of a transporting rail of the transporting frame, which can be moved in the manner of a parallelogram.

It can be seen from the illustration according to FIG. 1.1 that the first transporting rail 5, of which the end region is illustrated on an enlarged scale here, has a profiling 12, e.g. may be designed, for example, as a U-profile. The pivot pin 11 is fastened by means of a fillister-head screw on that wall of the first transporting rail 5 which extends perpendicularly to the plane of the drawing according to FIG. 1.1, it being possible for the catch to be pivoted automatically about the same. The angled end 10 of the catch 9 passes through a through-passage 15 in that wall of the first transporting rail 5 which extends perpendicularly to the plane of the drawing. The catches 9 each have a counterweight-forming section 9.1 on one side of the pivot pin 11 and, on the opposite side of the pivot pin 11, a section which forms the protrusion 9.2.

FIG. 2 shows the side view of the transporting rails of the transporting frame, which can be moved in the manner of a parallelogram.

The first transporting rail 5 and the second transporting rail 6 comprise mounting plates 13 arranged in the end regions in each case. Located in each case on the mounting plates 13, which are accommodated on rack-guide rails 19 (not illustrated in FIG. 2), are fillister-head screws or other components which are of rotationally symmetrical design and serve for accommodating slide bearings or, alternatively, bodies of rotation by means of which it is possible to displace the transporting rails 5, 6, designed as profiles 12, of the transporting frame 4, which can be moved in the manner of a parallelogram. Located at a distance apart from one another in the side walls of the first transporting rail 5 and the second transporting rail 6 are catches 9, which can be moved automatically in each case about their pivot pins 11 and have a section 9.1 functioning as a counterweight and a section 9.2 which is defined as a protrusion. In the region of the first point of articulation 7 and of the second point of articulation 8, at which the pivoting arm 2, which is illustrated in FIG. 1, is accommodated in an articulated manner, the transporting rails 5, 6 each comprise bolt bearings, in which pins, fillister-head screws or the like may be positioned, in order to allow an articulated design of the transporting frame 4, which comprises the first transporting rail 5 and the second transporting rail 6. Those walls of the first transporting rail 5 and of the second transporting rail 6 which are located in the plane of the drawing according to FIG. 2 each have through-passages 15, through which extend the catches 9, which terminate in the protrusion 9.2. The profiling 12 of the transporting rails 5, 6 (catch transporting rails) serves to increase the rigidity since, by way of the transporting rails 5, 6, the force is transmitted to the rack which is to be transported, and accommodates the items for washing. Furthermore, the two transporting rails 5, 6 restrict the rotary movement of the catches 9 about their pivot pin 11, with the result that it is possible to dispense with further measures, such as providing separate stop angles or the like. In the rest state of the catches 9, the counterweight-forming section 9.1 rests on the bottom leg of the transporting rail 5, 6. If the catch 9, which can be moved about its pivot pin 11, is tilted about the pivot pin 11 on account of the rearwardly directed movement of the first transporting rail 5 and/or of the second transporting rail, then the rotary movement of the catch 9 about the pivot pin 11 is limited by the counterweight-forming section 9.1 of the tilting catch striking against the respective top leg of the transporting rails 5, 6. The pivoting distance of the catch 9, said distance being provided by the profiling 12, is dimensioned such that the angled protrusion 9.2 of the catch 9 can move away downward beneath a base ribbing arrangement of the rack accommodating the items for washing.

Figure 3:
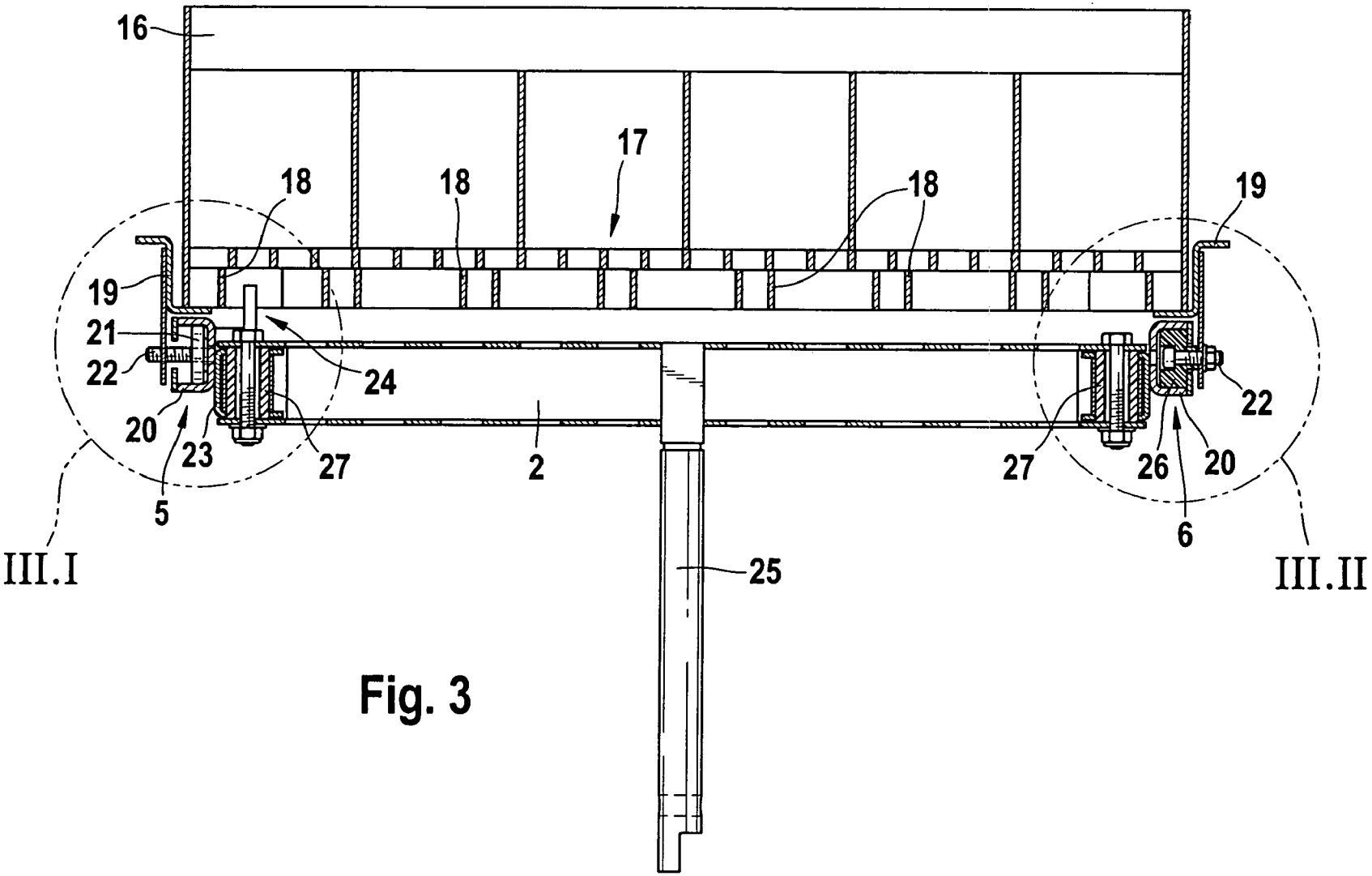
FIG. 3 shows the front view of the articulated transporting frame with pivoting arm and pivot pin for driving purposes, FIG. 3.1 shows a first location where the pivoting arm is articulated on the carriage-like, articulated transporting frame, FIG. 3.2 shows the mounting location of a transporting rail of the carriage-like, articulated transporting frame.

FIG. 3 shows the front view of a transporting frame which can be moved in the manner of a parallelogram.

It can be seen from the illustration according to FIG. 3 that a rack 16 accommodating items for washing, for example dishes or cutlery, is seated on rack-guide rails 19. The rack 16 accommodating the items for washing comprises a base ribbing arrangement 17 which contains intermediate ribs 18. Washing liquid or clean water can flow out via the interspaces of the base of the rack 16, said interspaces being formed by the ribbing arrangement. The rack-guide rails, which are designated 19, are arranged in a stationary manner in a straight-through dishwasher. The mounting plates 13 illustrated in FIG. 2 are fastened on the rack-guide rails 19. The mounting plates 13, for their part, accommodate one or more fillister-head screws 22. In turn, stationary slide bearings are accommodated on the fillister-head screws 22 or, alternatively, roller elements 21 are accommodated in a rotatable manner thereon. The slide bearings or, alternatively, roller elements 21 are enclosed by the profile 12 of the guide 20 of the transporting frame 4. The profile 12 forming the first transporting rail 5 allows the first transporting rail 5 to move relative to the rack-guide rail 19, which is arranged in a stationary manner. On the side which is directed toward the first transporting rail 5, the pivoting arm 2 is connected in a pivotable manner to the first transporting rail 5 by means of a bolt-like pin or of a fillister-head screw or the like. The fillister-head screw or the bolt are guided in a bearing bushing 27 which, for its part, is accommodated in a profile 23 on the outside of the pivoting arm 2. 24 designates the upright catch 9, i.e. the position in which the latter grips the base ribbing arrangement 17 of the rack 16.

The connection of the pivoting arm 2, which can be moved about a pivot pin 3, 25, at the end which is directed toward the second transporting rail 6 is formed analogously to the connection of the pivoting arm 2 to the end which is directed toward the first transporting rail 5. The mounting plate 13, on which fillister-head screws 22 are fixed, is located on the rack-guide rail 19 (see illustration according to FIG. 2). These fillister-head screws 22, for their part, accommodate slide bearings or, alternatively, roller-like bodies of rotation which fill a cavity 26 of the profile 12 and make it possible to guide the first transporting rail 5 and the second transporting rail 6 during the reciprocating linear movement on account of the pivoting movement of the pivoting arm 2.

FIG. 3.1 shows a first location where a pivoting arm is articulated on the transporting frame, which can be moved in the manner of a parallelogram.

The mounting plate 13 is connected to the rack-guide rail 19 via a connection which is not illustrated specifically in FIG. 3.1. The mounting plate 13 accommodates the fillister-head screw 22, on which a slide bearing is fastened, or alternatively, a roller 21 is fastened in a rotatable manner. The rack-guide rail 19, which is of Z-shaped design in the illustration according to FIG. 3.1, absorbs the weight of the rack 16, which can be conveyed along the rack-guide rail 19 extending perpendicularly to the plane of the drawing. The protrusions 9.2 of the catches 9 engage in the base ribbing arrangement 17 of the rack 16, said catches being accommodated in an automatically pivotable manner in the first transporting rail 5 and, on the opposite side of the rack 16, on the second transporting rail 6. The pivoting arm 2 may be designed, for example, as a U-profile. The longitudinal ends of the pivoting arm 2 overlap the legs of profiles 23, which are likewise of a U-shaped design and, for their part, are firmly connected to the transporting rails 5, 6. Welded into the U-profiles 23 are sleeves into which, in turn, mounting bushings 27 (plastic bearing bushings) are pressed. The bearing bushings 27, for their part, enclose connecting elements which are designed in the form of bolts and via which the pivoting arm 2 is connected in an articulated manner to the first transporting rail 5. The advancement and return-stroke movement of the first transporting rail 5 is made possible by the slide bearings or, alternatively, roller elements 21, which are accommodated on the mounting plates 13 which, for their part, are fastened in a stationary manner on the Z-shaped rack-guide rail 19.

FIG. 3.2 shows a mounting location of a transporting rail of the carriage-like articulated transporting frame in the front region of a dishwasher.

The two transporting rails 5, 6 are to be mounted in the longitudinal direction in the front region of a dishwasher since the two profiled transporting rails 5, 6 are not connected to one another within this region. In the rear region of the transporting rails 5, 6, the pivoting arm 2 provides very stable rotatable mounting (see illustration according to FIG. 6), the articulated connection between the transporting rails 5, 6 and the pivoting arm 2 which is illustrated in FIG. 3.1 rendering any additional mounting superfluous. It can be seen from the illustration according to FIG. 3.2 that slide-bearing blocks 26 are accommodated, via fillister-head screws 22, on the mounting plates 13, which accommodate the rack-guide rails 19. The slide-bearing blocks 26 are enclosed by the profiled transporting rail 6. Provided on the open sides of the transporting rails 5, 6 are securing plates 47 (see FIG. 2), which enclose the slide-bearing block 26 on its sides which are directed toward the mounting plate 13, in order to prevent the same from sliding out of the transporting rail 5, 6 in the direction of the center of the machine. The securing plates 47 are designed in such a length that, even in the case of a maximum stroke movement, the slide-bearing block 26 is secured against leaving the transporting rail 5 or 6. Instead of the slide-bearing blocks 26 illustrated in FIG. 3.2, it is also possible, as an alternative, for roller elements to be accommodated on the mounting plates 13, as is illustrated in FIG. 3.1.

Figure 4:
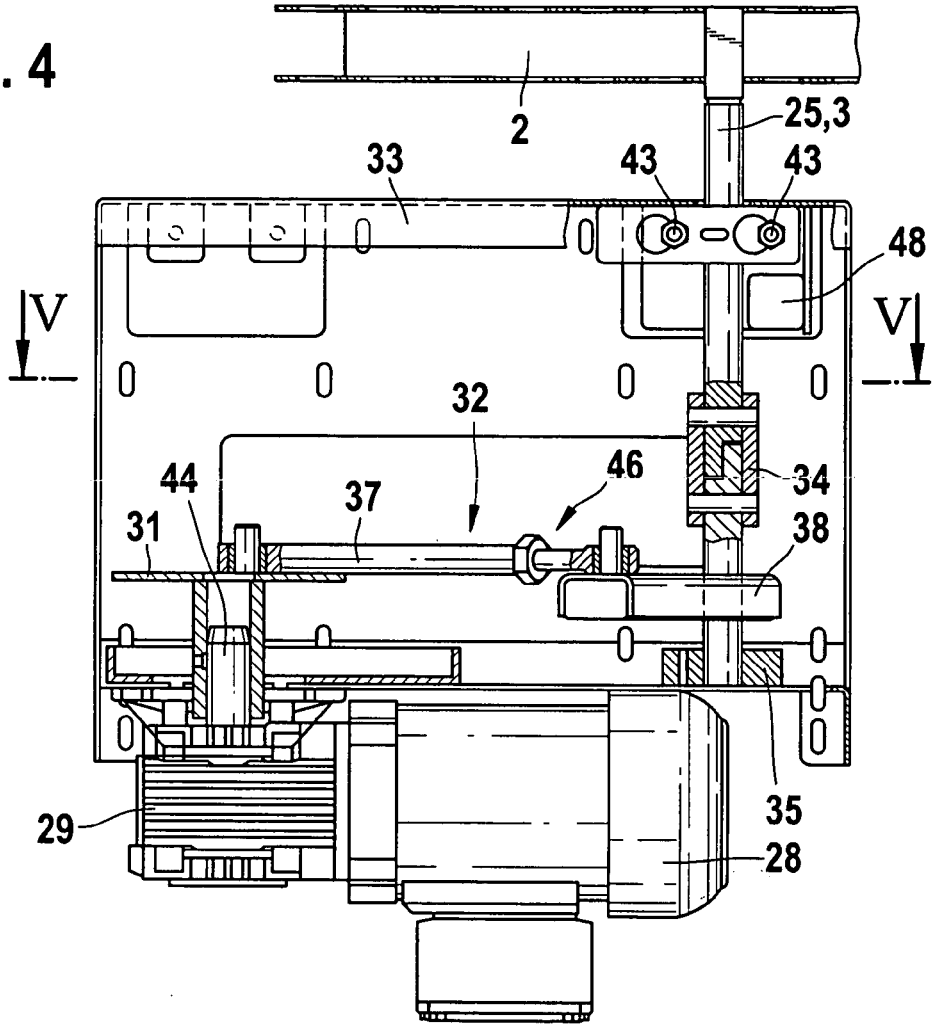
FIG. 4 shows a view of the rotary drive for the carriage-like transporting element.

FIG. 4 shows a view of the rotary drive for the transporting frame, which can be moved in the manner of a parallelogram, according to the illustration in FIG. 1.

The pivot drive 28, which introduces the pivoting movement into the pivoting arm 2, comprises a gear mechanism 29 which, for its part, drives an output shaft 44. Accommodated on the output shaft 44 of the gear mechanism 29 is a drive wheel 31, which is connected in a rotationally fixed manner to the output shaft 44 of the gear mechanism 29. The drive wheel 31 constitutes part of a crank mechanism, of which the other part is formed by a divided connecting rod 32. The connecting rod 32 is of divided design in the illustration according to FIG. 4 and comprises a first connecting-rod part 37 and a second connecting-rod part 38 which, by way of a thread with securing nut 46, allows the first connecting-rod part 37 to be adjusted in relation to the second connecting-rod part 38. The first connecting-rod part 37 is accommodated on a bolt of the drive wheel 31 and converts the rotary movement of the drive wheel 31 into a stroke movement. 36 designates a pan which protects the gear mechanism against the ingress of water in the possible event of leakage of the drive-shaft mounting in the base of the dishwasher. The first connecting-rod part 37 is connected to the second connecting-rod part 38 via a thread with securing nut 46. The second connecting-rod part 38 acts on the pivot pin 3, 25 and causes the latter to pivot. The pivoting arm 2 of the transporting frame 4, which can be moved in the manner of a parallelogram, is fastened in a rotationally fixed manner at the top end of the pivot pin 3 or 25. The pivot pin 3, 25 is supported in a bearing 35 on the underside of a housing. A section of the pivot pin 3 or 25 which accommodates the pivoting arm 2 and a further section of the pivot pin 3, 25 which is supported in the bearing 35 are connected to one another in a rotationally fixed manner via a plug-in coupling 34.

Figure 5:
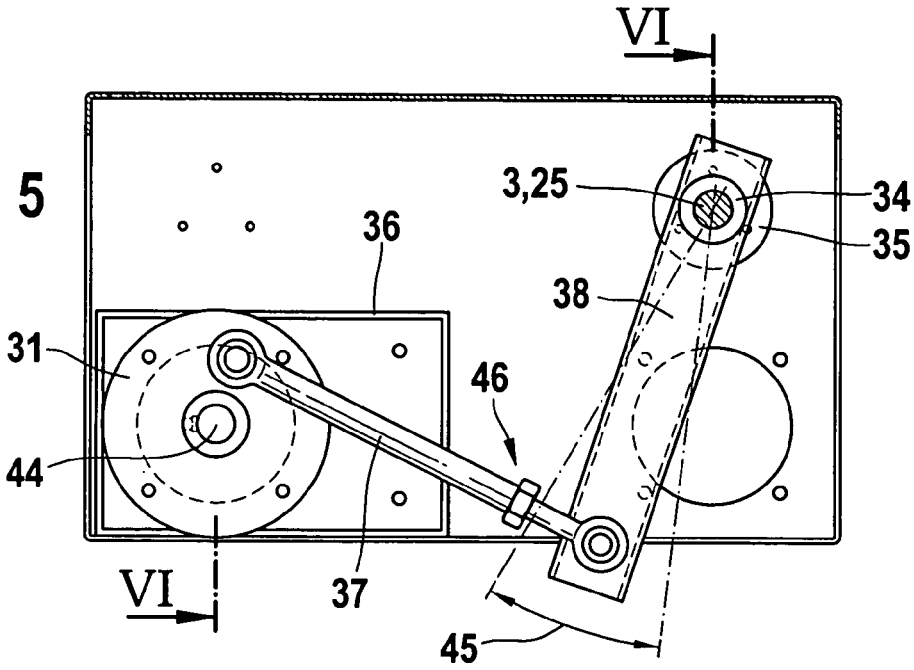
FIG. 5 shows a sectional illustration of the rotary drive according to FIG. 4.

FIG. 5 shows a sectional illustration of the rotary drive along section line V—V illustrated in FIG. 4.

It can be seen from the illustration according to FIG. 5 that the first connecting-rod part 37 is connected in an articulated manner to the drive wheel 31. The first connecting-rod part 37 is fastened on a bolt fitted on the top side of the drive wheel 31. It is possible to adjust, i.e. vary, a pivoting range 45 of the second connecting-rod part 38 via the thread with securing nut 46. A pivoting movement is introduced into the pivot pin 3 or 25, which is supported in the bearing 35 located on the underside of the housing, depending on the dimension of the pivoting range 45 of the second connecting-rod part 38. Depending on the deflection of the pivot pin 3 or 25 within the pivoting range 45, the pivoting arm 2 is pivoted and thus stroke movements running in opposite directions are introduced into the first transporting rail 5 and the second transporting rail 6 of the transporting frame 4, which can be moved in the manner of a parallelogram (see FIG. 1).

Figure 6:
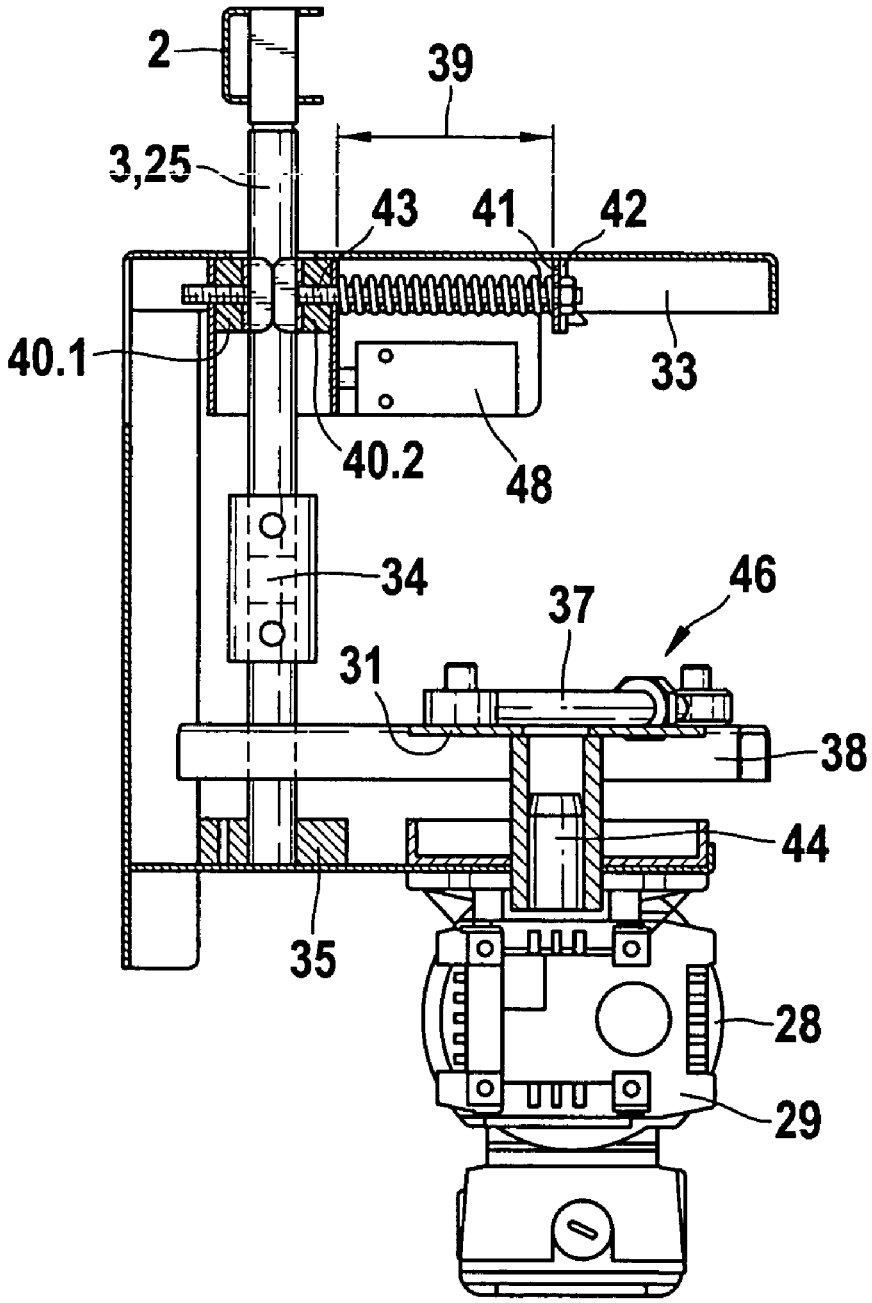
FIG. 6 shows a further section through the rotary drive according to FIG. 4.

FIG. 6 shows a further section through the pivot drive according to the illustration in FIG. 4.

It can be seen from the illustration according to FIG. 6 that the pivot drive 28 and the gear mechanism 29, which is driven by the pivot drive 28, are arranged in alignment one behind the other. The output of the gear mechanism 29 acts, via the output shaft 44, on the drive wheel 31, which drives the connecting rod 32, which is illustrated in FIG. 4 and comprises a first connecting-rod part 37 and a second connecting-rod part 38. This connecting rod converts the rotary movement of the drive wheel 31 into a pivoting movement, which is transmitted to the pivot pin 3, 25, which is designed in two parts.

A bracket 33 is arranged in the top region of the housing which accommodates components 31, 32; 37, 38 forming the crank mechanism. The bracket 33 comprises a retaining plate 41 and a securing lug for accommodating a securing bolt 43, which is enclosed by a spring element. That end of the bolt 43 which is located opposite the securing lug 42 is supported in a tubular attachment on the underside of the bracket 33, enclosing the pivot pin 3, 25. The pivot pin 3, 25 and its downward extension is guided on the base of the bracket 33 by way of the bearing 35. The top mounting of the pivot pin 3, 25 is provided by two slide bearings 40.1, 40.2 which are formed in the manner of half-shells and enclose the pivot pin 3, 25. The two slide-bearing shells 40.1 and 40.2, for their part, are enclosed by two sheet-metal lugs. The sheet-metal lugs and the two slide-bearing shells 40.1, 40.2 are connected to one another by two threaded rods 43, with helical springs pushed thereon, a retaining plate 41 and a nut. When the nut is tightened, the helical springs are compressed, as a result of which prestressing 39 is established. The thus established prestressing produces a force by means of which the two slide-bearing shells 40.1 and 40.2, which enclose the pivot pin 3, 25, are positioned against one another. In order that the two slide-bearing shells 40.1, 40.2 are fixed, a plate, which is fastened in a stationary manner on the bracket 33, is located between the two slide-bearing half-shells 40.1, 40.2.

By virtue of the prestressing of the slide-bearing shells 40.1, 40.2, which are enclosed by the two sheet-metal lugs, the transportation of the rack 16 can be switched off, which may be brought about, for example, by items for washing which have fallen out of the rack 16 jamming. If the articulated transporting carriage 4 jams during operation and is prevented from moving forward, the pivot drive 28 would continue operating and would subject the transporting frame 4 to an inadmissibly high force in the longitudinal direction. This inadmissably high force would then act on one of the two slide-bearing shells 40.1, 40.2, which enclose the pivot pin 3, 25. If then, in the event of malfunctioning, the force is so large that it exceeds the spring prestressing, which can be adjusted individually in accordance with the machine size and holds the two slide-bearing half-shells 40.1, 40.2 together, one of the two slide-bearing half-shells 40.1 and 40.2 will move out counter to the spring prestressing 39 and travel a certain distance. This displacement is utilized in order to actuate an electric switch 48, which switches off the pivot drive 28. The electric switch 48, according to the illustration in FIG. 6, is accommodated on one of the two plates enclosed by the slide-bearing half-shells 40.1, 40.2.

The rotary movement which is produced by the pivot drive 28, and transmitted to the drive wheel 31, is converted into a reciprocating movement by the multi-part connecting rod 32. The reciprocating movement results in reciprocating pivoting of the pivot pin 3, 25 in and counter to the clockwise direction, in accordance with the pivoting range 45 adjusted by the adjusting screw 46. The reciprocating pivoting of the pivot pin 3, 25, in turn, produces reciprocating pivoting of the pivoting arm 2, on which the first transporting rail 5 and the second transporting rail 6, each provided with catches 9, are accommodated in an articulated manner. This achieves the situation where the first transporting rail 5 and the second transporting rail 6 of the transporting frame 4, which can be moved in the manner of a parallelogram, move in opposite directions to one another. If one of the transporting rails 5 and 6 is in the process of executing a forward movement, the transporting rail 5, 6 located opposite moves in the rearward direction and vice versa. In the case of a half revolution of the drive wheel 31, for example, the first transporting rail 5 moves forward by a stroke length and moves the rack 16, accommodating the items for washing, along with it, while the other of the two transporting rails 5, 6 is moved in the rearward direction. In the case of the following half revolution of the drive wheel 31, the procedure takes place precisely in reverse, i.e. the other of the two transporting rails 5, 6 executes a forward stroke and conveys the rack 16, accommodating the items for washing, along with it.

This solution achieves the situation where the transporting frame 4, which can be moved in the manner of a parallelogram, executes two stroke movements per revolution of the drive wheel 31 rather than, as is customary with conventional designs, just one stroke movement per revolution of the drive wheel. As a result, it is now possible for the standstill time which arises in the prior art during the rearwardly directed stroke of a carriage of rigid design likewise to be utilized for the advancement movement of the rack 16 accommodating the items for washing. Consequently, then, using the solution proposed according to the invention results in a ratio of advancement time to standstill time of, in theory, 100:0 (albeit of 80:20 in practice) on account of the overshooting in relation to the prior-art solution of, in theory, 50:50 (40:60 in practice).

The solution proposed according to the invention makes it possible to achieve a more uniformly running transporting movement of the rack 16 as it passes through a rack-type straight-through dishwasher. The ratio of advancement duration to standstill duration of the rack 16 has been altered such that the standstill duration of the rack 16 accommodating the items for washing is reduced to a minimum and the advancement duration of the rack 16 accommodating the items for washing, in favour of a lower transporting speed during a stroke, is increased to a maximum. With the same dishes output, a far better washing result is achieved on account of the more uniformly running movement of the rack 16; with otherwise identical washing parameters, it is possible to increase the throughput of items for washing in order to obtain the same washing result. The more uniformly running movement of the rack 16 makes it possible to reduce the quantity of clean water necessary for the rinsing process. During the rinsing process, clean hot water rinses off the washing liquid from the items for washing. A reduction in the quantity of clean water which is to be heated up for rinsing purposes reduces the heating output necessary for heating up the clean water, which, overall, increases the cost-effectiveness of a rack-type straight-through dishwasher to a considerable extent.

LIST OF DESIGNATIONS

1 Axis of symmetry
2 Pivoting arm
3 Pivot pin
4 Transporting frame
5 First transporting rail
6 Second transporting rail
7 First point of articulation
8 Second point of articulation
9 Catch
9.1 Counterweight section
9.2 Conveying protrusion
10 Angled portion
11 Pivot pin, catch
12 Profiling
13 Mounting plate
14 Bolt bearing
15 Through-passage through transporting-rail wall
16 Rack
17 Base ribbing arrangement
18 Intermediate ribs
19 Rack-guide rails
20 Guide, transporting frame
21 Roller element
22 Fillister-head screw
23 U-profile
24 Upright position of catch
25 Pivot pin
26 Slide-bearing block
27 Bearing bushing

28 Pivot drive
29 Gear mechanism
30 Drive crank
31 Drive wheel
32 Connecting rod
33 Bracket
34 Plug-in coupling
35 Bearing, pivot pin
36 Housing
37 First connecting-rod part
38 Second connecting-rod part
39 Prestressing spring
40.1 First slide-bearing shell
40.2 Second slide-bearing shell
41 Retaining plate
42 Securing lug
43 Threaded rod
44 Output shaft
45 Pivoting range
46 Thread with securing nut
47 Securing plate
48 Electric switch

What is claimed is:

1. A dishwasher with devices for translating the rotary movement of an output shaft of a pivot drive into a reciprocating linear movement, the dishwasher comprising:

a receptacle for items for washing; and a transporting device for conveying the receptacle, the transporting device including catches engaging the receptacle in one direction and not engaging the receptacle in an other direction and including an articulated transporting frame with transporting rails, the transporting rails being movable such that a conveyance stroke in a conveying direction of one of the transport rails results in an equal magnitude return stroke of an other transport rail, a drive wheel driving the transporting rails, the transporting rails executing in each case two stroke cycles comprising the conveyance stroke and the return stroke during one rotation of the drive wheel.

2. The dishwasher as recited in claim 1 wherein the transporting device is a reciprocating transporting device of a straight-through dishwasher driven by the pivot drive.

3. The dishwasher as recited in claim 1 further comprising a pivot pin and wherein the transporting frame includes a cross member connecting the transporting rails, the cross member being pivotable about the pivot pin.

4. The dishwasher as recited in claim 1 wherein the transporting rails move in opposite directions while remaining parallel to each other.

5. The dishwasher as recited in claim 1 wherein the transporting rails are designed as hollow profiles having walls, the catches being connected to the transporting rails via pilot pins arranged in the walls.

6. The dishwasher as recited in claim 3 further comprising a crank mechanism having a connecting rod with two parts adjustable relative to one another, the crank mechanism driving the pivot pin.

7. The dishwasher as recited in claim 6 wherein the crank mechanism has the drive wheel driven by the pivot drive, one of the connecting-rod parts being articulated on the drive wheel.

8. The dishwasher as recited in claim 5 wherein the catch in each case has a counterweight-forming section and a protusion movable into an extended position.

9. The dishwasher as recited in claim 1 further comprising slide bearings or roller elements enclosed by the transporting rails, the slide bearing being fastened on pins, the pins being accommodated on mounting elements fixed on guide rails for guiding the receptacle for items for washing.

10. The dishwasher as recited in claim 1 wherein the receptacle is a rack having a base surface with base ribbing having intermediate ribs and clearances for engagement of the catches.

11. A dishwasher with devices for translating the rotary movement of an output shaft of a pivot drive into a reciprocating linear movement, the dishwasher comprising:

a receptacle for items for washing;

a transporting device for conveying the receptacle, the transporting device including catches engaging the receptacle in one direction and not engaging the receptacle in an other direction and including an articulated transporting frame with transporting rails, the transporting rails being movable;

a pivot pin, the transporting frame includes a cross member connecting the transporting rails, the cross member being pivotable about the pivot pin; and a crank mechanism having a connecting rod with two parts adjustable relative to one another, the crank mechanism driving the pivot pin.

12. The dishwasher as recited in claim 11 wherein the crank mechanism has a drive wheel driven by the pivot drive, one of the connecting-rod parts being articulated on the drive wheel.

* * * * *